US007558508B2

(12) United States Patent
Yamazaki et al.

(10) Patent No.: US 7,558,508 B2
(45) Date of Patent: Jul. 7, 2009

(54) IMAGE FORMING APPARATUS HAVING BELT WOUND AROUND ROLLER WITH SPECIFIC ROUGHNESS

(75) Inventors: Hiroshi Yamazaki, Osaka (JP); Tomohide Hozono, Osaka (JP); Mitsuhiro Hashimoto, Osaka (JP); Takeshi Watanabe, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/970,699

(22) Filed: Jan. 8, 2008

(65) Prior Publication Data

US 2008/0181664 A1 Jul. 31, 2008

(30) Foreign Application Priority Data

Jan. 26, 2007 (JP) ..... 2007-016431

(51) Int. Cl.
*G03G 15/00* (2006.01)
*G03G 15/01* (2006.01)

(52) U.S. Cl. ..... 399/162; 399/302; 399/303

(58) Field of Classification Search ..... 399/162, 399/299, 302, 303, 308, 312, 313
See application file for complete search history.

(56) References Cited

U.S. PATENT DOCUMENTS 6,816,691 B2 * 11/2004 Kabata et al. ..... 399/165
7,078,143 B2 * 7/2006 Hashimoto et al. ..... 430/131
7,162,193 B2 * 1/2007 Ozawa et al. ..... 399/308
7,174,124 B2 * 2/2007 Ishibashi et al. ..... 399/302
2006/0210326 A1 * 9/2006 Takehara et al. ..... 399/302

FOREIGN PATENT DOCUMENTS

JP 62137106 A * 6/1987
JP 2005-43593 2/2005

* cited by examiner

*Primary Examiner*—Robert Beatty
(74) *Attorney, Agent, or Firm*—Gerald E. Hespes; Anthony J. Casella

(57) ABSTRACT

An image forming apparatus includes: a plurality of rollers; and an endless belt wound around said rollers, said rollers including: a driving roller which drives said belt wound around said rollers and a driven roller set which is driven by said driving roller via the movement of the endless belt, said driven rollers having one or more metal rollers. At least one of said metal rollers is a smooth roller which satisfies following conditions (i) and (ii); (i) a surface roughness Rz≦2 μm; and (ii) an arithmetic inclination average Δa≦0.06; where said Δa is obtained from an equation (1) below:

$$\Delta a = \frac{1}{L}\int_0^L \left|\frac{d}{dx} f(x)\right| dx \qquad (1)$$

where L=a reference length taken from a roughness curve; f (x)=a height of the roughness curve at a position x within said reference length L along a lengthwise direction of the roller.

8 Claims, 6 Drawing Sheets

IMAGE FORMING APPARATUS HAVING BELT WOUND AROUND ROLLER WITH SPECIFIC ROUGHNESS

BACKGROUND OF THE INVENTION

1. Field of the Invention

The present invention relates to an image forming apparatus, such as a copying machine, a printer, a facsimile machine, and a complex machine having functions of those, which adopts an electrophotographic method.

2. Description of the Related Art

An image forming apparatus, such as a copying machine, a printer, a facsimile machine, and a complex machine having functions of those, adopting an electrophotographic method includes an image bearing member, a charging device which is adapted to evenly charge a surface of the image bearing member, an exposure device which is adapted to form an electrostatic latent image on the image bearing member, a developing device which is adapted to develop the electrostatic latent image formed on the image bearing member to be a toner image, and a transferring device which is adapted to transfer the toner image formed on the image bearing member to a sheet. Further, there may be further provided a cleaning device which is adapted to remove toners, which reside on the image bearing member after the toner image formed on the image bearing member is transferred to the sheet, from the image bearing member.

In such image forming apparatus, there has been a known image forming apparatus using an endless belt wound around a plurality of rollers. For example, such image forming apparatus includes an image forming apparatus which has an intermediate image bearing member including a belt (intermediate transferring belt) and adapted to primarily receive a toner image formed on the image bearing member by the electrophotographic method and thereafter secondarily transfer the toner image to a transfer member, and an image forming apparatus which has a transfer member conveying member including a belt (transfer member conveying belt) and adapted to directly transfer the toner image bore by the image bearing member, and an image forming apparatus which has an image bearing member including a belt (photoconductive belt) and adapted to bear a toner image formed by the electrophotographic method.

For example, the image forming apparatus using the intermediate transferring belt includes a tandem color image forming apparatus having a color printing function of forming a color image by superimposing toners of a plurality of colors, such as yellow (Y), magenta (M), cyan (C), and black (K) onto the intermediate transferring belt. In such color image forming apparatus, developing devices corresponding to respective colors are arranged along the intermediate transferring belt to superimpose toners of a plurality of colors. Further, the intermediate transferring belt is wound around a plurality of rollers, and the plurality of rollers are classified into a driving roller adapted to drive the intermediate transferring belt and a driven roller driven by the driving roller via the movement of the intermediate transferring belt.

In accordance with the driving of the driving roller, toner images of four colors, e.g. Y, M, C, K, formed by respective photoconductive drums of the developing devices are sequentially transferred (primarily transferred) to the intermediate transferring belt so that the toner images are superimposed one after another. Then, the color image formed on the intermediate transferring belt is transferred (secondarily transferred) to a transfer member such as a sheet by a secondary transferring roller which is provided so as to face the intermediate transferring belt. However, when a metal roller made of aluminum or the like is used as a driven roller in the tandem image forming apparatus, the intermediate transferring belt and the metal roller come into friction, so that a surface (back surface) of the intermediate transferring belt in contact with the metal roller, and a surface of the metal roller get damaged. Thus, if the image forming is performed for a long time, such damage becomes noticeable, so that it causes uneven thickness of the intermediate transferring belt to occur. A high-quality image cannot be obtained by such intermediate transferring belt having an uneven thickness even if the secondary transfer is performed by applying a predetermined bias to the intermediate transferring belt.

As an example of an image forming apparatus using a belt wound around a plurality of rollers to reduce such occurrence of uneven thickness of the belt, there has been a known image forming apparatus in which a hollow pipe made of aluminum which has a surface hardness of 500 HV or greater and a surface roughness Rz of 2 μm or less is used as a roller around which a belt (transfer member conveying belt) is wound (refer to Japanese Patent Unexamined Publication No. 2005-43593: hereinafter, referred to as a patent document 1).

The above-described patent document 1 discloses that when the hollow pipe is used as a roller, a surface nature of the roller can be maintained regardless of the number of times of use and a use environment, so that damage to the belt can be reduced.

However, occurrence of the uneven thickness cannot be actually reduced by the configuration of the patent document 1, and generation of such damage on the belt may become earlier. Therefore, this image forming apparatus cannot form a high-quality image.

SUMMARY OF THE INVENTION

The present invention was made to solve the conventional problems, and its object is to provide an image forming apparatus which is capable of preventing occurrence of an uneven thickness of a belt and forming a high-quality image even after a long-time use.

The present invention includes an image forming apparatus comprising: a plurality of rollers; and an endless belt wound around said rollers, said rollers including: a driving roller which drives said belt wound around said rollers and a driven roller set which is driven by said driving roller via the movement of the endless belt, said driven rollers having one or more metal rollers. At least one of said metal rollers is a smooth roller which satisfies following conditions (i) and (ii); (i) a surface roughness Rz≦2 μm; and (ii) an arithmetic inclination average Δa≦0.06; where said Δa is obtained from an equation (1) below:

$$\Delta a = \frac{1}{L}\int_0^L \left|\frac{d}{dx} f(x)\right| dx \tag{1}$$

where

L=a reference length taken from a roughness curve;

f (x)=a height of the roughness curve at a position x within said reference length L along a lengthwise direction of the roller.

According to this configuration, since a surface roughness Rz of the metal roller in a frictional contact with the belt is such a small value of 2 μm or less, there is no large projection on the surface of the metal roller. Further, since an arithmetic inclination average Δa of the surface of the metal roller is such a small value of 0.06 or less, inclination of small irregularity existing on the surface is very small. Accordingly, since the metal roller is a smooth roller having a very smooth surface, it can prevent occurrence of damages on the back surface of the belt caused by the metal roller. Thus, according to the present invention, the back surface of the belt is not likely to be damaged, so that occurrence of the uneven thickness of the belt can be prevented, and a high-quality image can be formed even after a long-time use.

These and other objects, features and advantages of the present invention will become apparent upon reading of the following detailed description along with the accompanied drawings.

DETAILED DESCRIPTION OF THE PREFERRED EMBODIMENTS

First Embodiment

Figure 1:
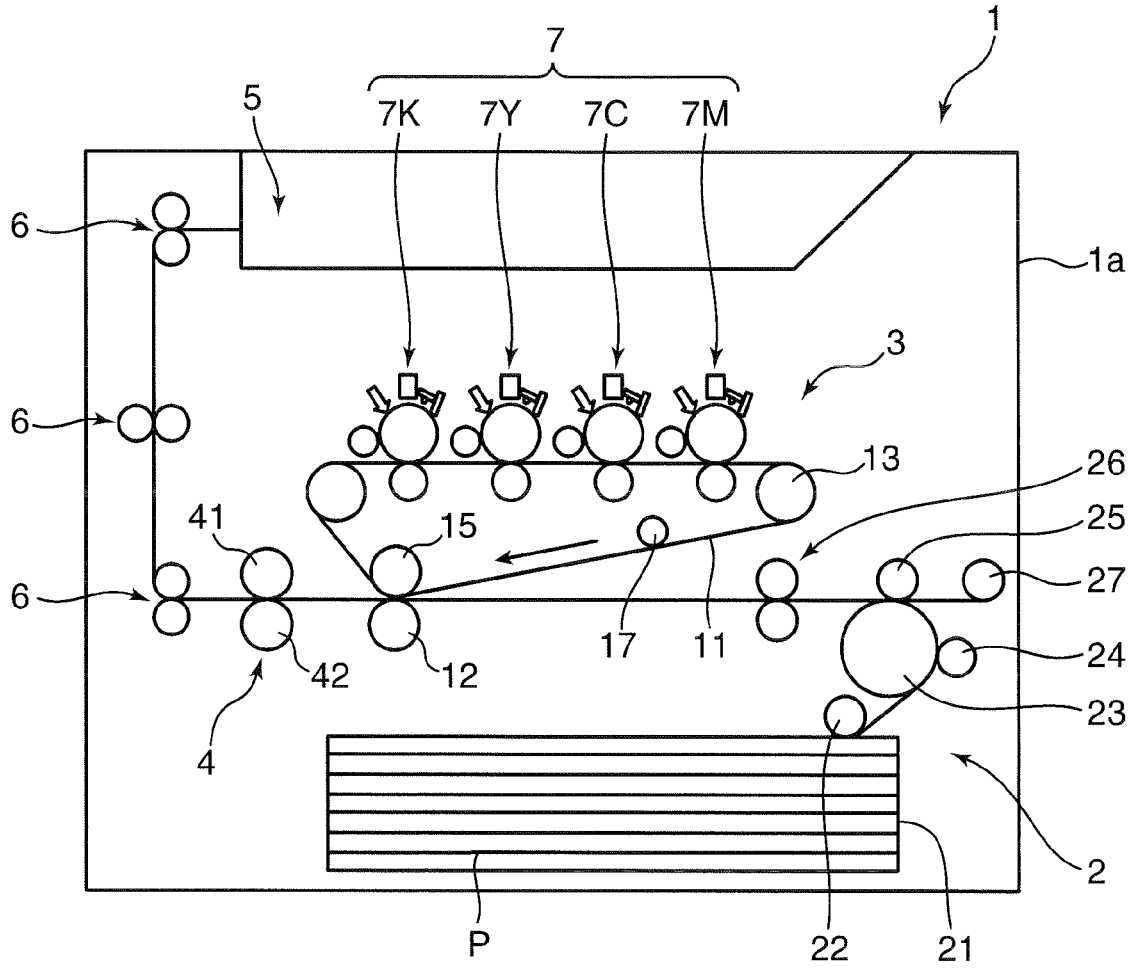
FIG. 1 is a sectional view schematically showing an overall configuration of a color printer 1 in accordance with a first embodiment of the present invention.
Figure 2:
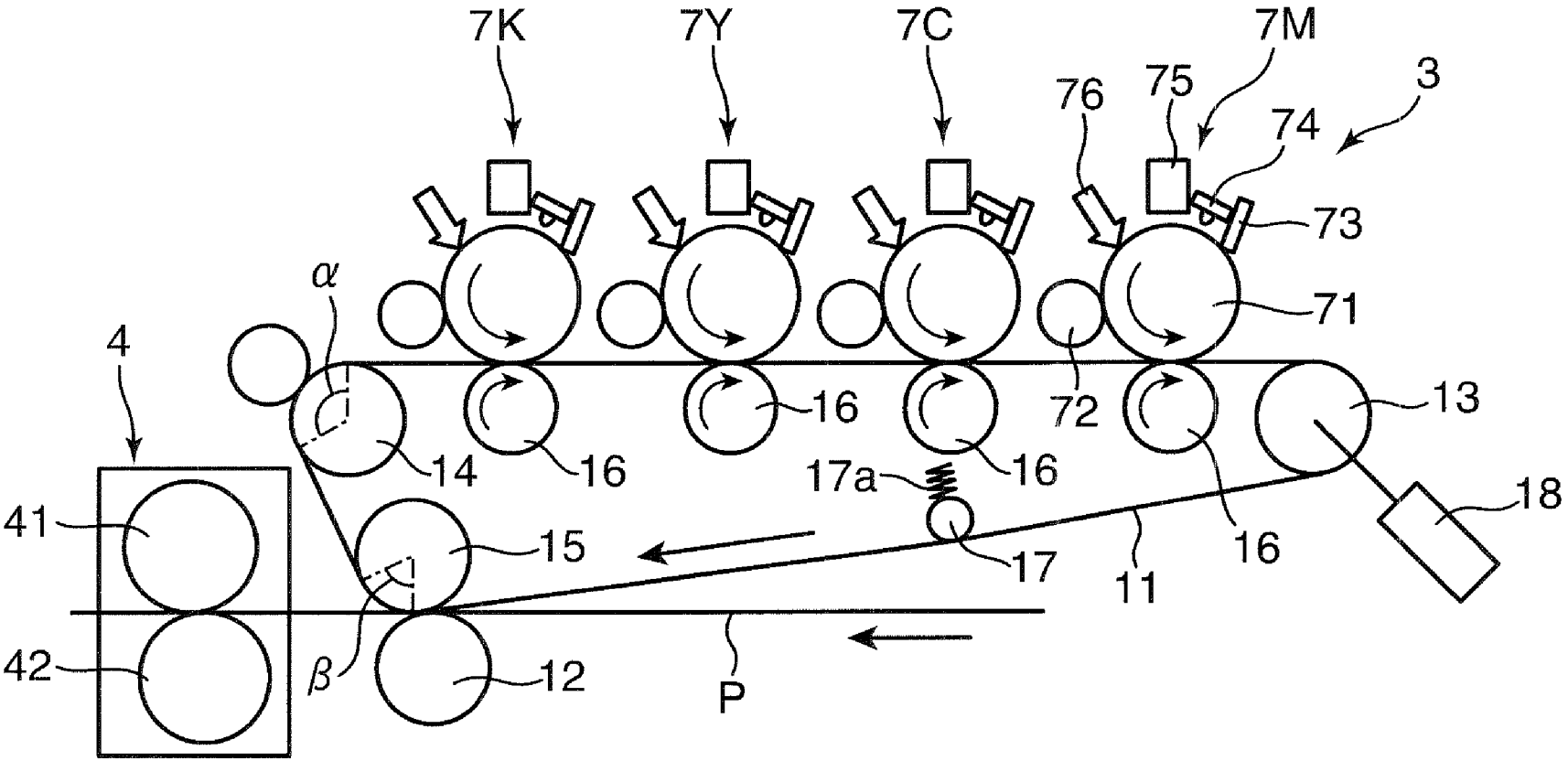
FIG. 2 is an enlarged view showing relevant parts of a configuration of a periphery of an image forming section 3 of the color printer shown in FIG. 1.

FIG. 1 is a sectional view showing an overall configuration of a color printer 1 in accordance with a first embodiment of the present invention. FIG. 2 is an enlarged view showing relevant parts of a configuration of a periphery of an image forming section 3 of the color printer 1 shown in FIG. 1. Firstly, an overall configuration of the tandem color printer 1 in accordance with the first embodiment of the present invention will be described with reference to FIGS. 1 and 2.

The color printer 1 includes a box-shaped main body 1*a* as shown in FIG. 1. In the main body 1*a*, there are provided a sheet feeding section 2 adapted to feed a sheet P, an image forming section 3 adapted to convey the sheet P fed by the sheet feeding section 2 and form an image on the sheet P, and a fixing section 4 adapted to perform a fixing processing to the image which is transferred onto the sheet P in the image forming section 3. Further, on an upper surface of the main body 1*a*, there is provided a sheet-discharging section 5 to which the sheet P applied with the fixing processing in the fixing section 4 is discharged.

The sheet feeding section 2 includes a sheet feeding cassette 21, a pickup roller 22, sheet feeding rollers 23, 24, 25, and a registration roller 26. The sheet feeding cassette 21 is provided so as to be detachable from the main body 1*a* and is adapted to store sheets P of respective sizes. The pickup roller 22 is provided at an upper right position of the sheet feeding cassette 21 as shown in FIG. 1 and is adapted to take out sheets P stored in the sheet feeding cassette 21 one after another. The sheet feeding rollers 23, 24, 25 are adapted to send the sheets P taken by the pickup roller 22 to a sheet conveying passage. The registration roller 26 allows the sheet P sent to the sheet conveying passage by the sheet feeding rollers 23, 24, 25 to wait temporarily, and thereafter feeds the sheet P to the image forming section 3 at a predetermined timing.

Further, the sheet feeding section 2 is provided with an unillustrated manual feeding tray which is attached on the right side of the main body 1*a* shown in FIG. 1, and a pickup roller 27. The pickup roller 27 picks up sheets P placed on the manual feeding tray. The sheet P picked up by the pickup roller 27 is sent to the sheet conveying passage by the sheet feeding rollers 23, 25, and fed to the image forming section 3 by the registration roller 26 at a predetermined timing.

The image forming section 3 includes image forming units 7, an intermediate transferring belt 11 having a surface (contact surface) onto which toner images are primarily transferred by the image forming units 7, and a secondary transferring roller 12 adapted to secondarily transfer the toner image formed on the intermediate transferring belt 11 to the sheet P sent from the sheet feeding cassette 21.

The image forming units 7 have a black unit 7K, a yellow unit 7Y, a cyan unit 7C, and a magenta unit 7M, which are arranged sequentially from an upstream side (left side in FIG. 1) to a downstream side. Each of the units 7K, 7Y, 7C, 7M has at its central position a photoconductive drum 71 as an image bearing member which is so arranged as to be rotatable in an arrow (counter-clockwise) direction. Further, in periphery of each photoconductive drum 71, there are provided a charging device 75, an exposure device 76, a developing device 72, a cleaning device 73, and a charge removing device 74, which are arranged in sequential order from the upstream side along a rotational direction.

The charging device 75 evenly charges a peripheral surface of the photoconductive drum 71 which is rotated in the arrow direction. The charging device 75 may be, for example, a scorotron charging device. The exposure device 76 is so-called laser scanning unit. The exposure device 76 irradiates laser light in accordance with image data inputted by an image reading device or the like to the peripheral surface of the photoconductive drum 71 evenly charged by the charging device 75 to form an electrostatic latent image on the photoconductive drum 71 in accordance with image data. The developing device 72 supplies toners to the peripheral surface of the photoconductive drum 71 on which the electrostatic latent image is formed to allow a toner image in accordance with image data to be formed. Then, the toner image is primarily transferred to the intermediate transferring belt 11. After the primary transfer of the toner image to the intermediate transferring belt 11 is terminated, the cleaning device 73 cleans toners resided on the peripheral surface of the photoconductive drum 71. After the primary transfer is terminated, the charge removing device 74 removes electric charge from the peripheral surface of the photoconductive drum 71. The peripheral surface of the photoconductive drum 71 to which the cleaning process is performed by the cleaning device 73 and the charge removing device 74 moves to the charging device 75 for a new charging processing, and then the primary transfer is newly performed.

The intermediate transferring belt 11 is an endless belt which is wound around a plurality of rollers such as a driving roller 13, belt supporting roller 14, a backup roller 15, primary transferring rollers 16, and a tension roller 17 so that its surface (contact surface) side comes in contact with respective peripheral surfaces of the photoconductive drums 71. Further, the intermediate transferring belt 11 is so configured as to be rotated endlessly by the plurality of rollers in such a state that it is pressed against the photoconductive drums 71 by the primary transferring rollers 16 respectively facing the photoconductive drums 71.

The driving roller 13 is driven rotationally by a drive power source 18 such as a stepping motor, and gives a drive force for the endless rotation of the intermediate transferring belt 11. It is preferable that the driving roller 13 is a roller having an elastic member layer including a urethane rubber. Such configuration suppresses occurrence of slipping between the intermediate transferring belt 11 and the driving roller 13 and improves a drive force transmissibility, so that the intermediate transferring belt 11 can be easily driven rotationally.

The belt supporting roller 14, the backup roller 15, the primary transferring rollers 16, and the tension roller 17 are driven rollers which are rotatably provided and rotated by the driving roller 13 via the endless rotation of the intermediate transferring belt 11. These driven rollers 14, 15, 16, 17 are driven by the main rotation of the driving roller 13 via the intermediate transferring belt 11 and support the intermediate transferring belt 11. Further, the tension roller 17 and the primary transferring rollers 16 move in such a manner as described herebelow.

The tension roller 17 gives a tension (tensile force) to the intermediate transferring belt 11 so that the intermediate transferring belt 11 is not loosened. The tension roller 17 is biased by, for example, a biasing member 17*a* such as a spring member, so that it applies a pressure to the intermediate transferring belt 11 from the back surface (inner peripheral side) of the intermediate transferring belt 11 toward a front surface (outer peripheral side) thereof to generate a tension.

The primary transferring roller 16 applies a primary transfer bias (a polarity opposite to a charge polarity of toners) to the intermediate transferring belt 11. Accordingly, the toner images respectively formed on the photoconductive drums 71 are sequentially transferred (primarily transferred) in superimposition to the intermediate transferring belt 11, which is rotated in an arrow (clockwise) direction by driving of the driving roller 13, at positions between the photoconductive drums 71 and the primary transferring rollers 16.

The driven rollers 14, 15, 16, 17 include metal rollers having at least a surface made of metal, and a rubber roller whose surface is made of an elastic member, and at least one of the driven rollers 14, 15, 16, 17 is a metal roller. It is often likely that the driven rollers (primary transferring roller) 16 are electrically conductive rubber rollers. The metal roller used as a driven roller will be described hereinafter.

The secondary transferring roller 12 applies a secondary transfer bias having a polarity opposite to that of the toner image to the sheet P. Accordingly, the toner image primarily transferred to the intermediate transferring belt 11 is transferred to the sheet P at a position between the secondary transferring roller 12 and the backup roller 15, so that a color transferred image is formed on the sheet P.

The fixing section 4 is adapted to apply a fixing processing to the transferred image which is transferred to the sheet P in the image forming section 3, and includes a heating roller 41 heated by an electric heating member and a pressing roller 42 which is so arranged as to face the heating roller 41 and comes in pressed contact at its peripheral surface with a peripheral surface of the heating member 41.

Then, the transferred image which is transferred to the sheet P by the secondary transferring roller 12 in the image forming section 3 is fixed onto the sheet P by the fixing processing which is applied with use of heat at a time when the sheet P passes through a position between the heating roller 41 and the pressing roller 42. Then, the sheet P to which the fix processing is applied is discharged to the sheet-discharging section 5. Further, in the color printer 1 of the present embodiment, there are provided conveying rollers 6 at appropriate portions between the fixing section 4 and the sheet-discharging section 5.

Next, a metal roller which is used as a driven roller will be described. At least one of the metal rollers is a smooth roller having a surface roughness Rz of 2 μm or less and having a surface arithmetic inclination average Δa, which can be obtained from an equation (1) below, of 0.06 or less.

$$\Delta a = \frac{1}{L}\int_0^L \left|\frac{d}{dx}f(x)\right| dx \tag{1}$$

where

L is a reference length taken from a roughness curve, and f(x) is a height of the roughness curve at a position x along a lengthwise direction of a roller which is subject to measurement.

A surface roughness Rz is a ten point average roughness according to JIS B 0601:1994 which indicates a sum of an average of absolute values of peak heights of five highest peaks and an average of absolute values of valley depths of five deepest valleys within a roughness curve having a reference length.

An arithmetic inclination average Δa is a value which can be obtained from the equation (1) and indicates an arithmetic average value of absolute values which can be obtained by taking a reference length L from the roughness curve according to JIS B 0601:1994, differentiating the taken part to obtain an inclination curve, and obtaining absolute values of respective points of the curve.

As described above, since a surface roughness Rz of the metal roller in frictional contact with the intermediate transferring belt 11 is such a small value of 2 μm or less, there is no large projection on the surface of the metal roller. Further, since an arithmetic inclination average Δa of the surface of the metal roller is such a small value of 0.06 or less, inclination of small irregularity existing on the surface is very small. Accordingly, since the metal roller is a smooth roller having a very smooth surface, it can prevent occurrence of damages on the back surface of the intermediate transferring belt 11 caused by the metal roller. Thus, according to the color printer 1 of the present embodiment, the back surface of the intermediate transferring belt 11 is not likely to be damaged, so that occurrence of the uneven thickness on the intermediate transferring belt 11 can be prevented, and a high-quality image can be formed even after a long-time use.

Further, in a case where a plurality of metal rollers are used as driven rollers in the color printer 1, in other words, in a case where at least two of the driven rollers 14, 15, 16, 17 are metal rollers, adopting the smooth rollers for any of the metal roller can achieve the effect of preventing generation of the uneven thickness on the belt. However, it is preferable to have the following configurations.

If a metal roller which comes in pressed contact with the intermediate transferring belt 11 most strongly has irregularity on its surface, it is likely to damage the back surface of the intermediate transferring belt 11. Therefore, the metal roller which comes in pressed contact with the intermediate transferring belt 11 most strongly is preferable as a part which is replaced with the smooth roller. Further, in a case of the color printer 1 having the image forming section 3 shown in FIG. 2, the metal roller which comes in pressed contact with the intermediate transferring belt 11 most strongly is the belt supporting roller 14.

A metal roller having a greatest contact angle of the intermediate transferring belt 11 comes in contact with the intermediate transferring belt 11 for a relatively long area (time). If such roller has irregularity on its surface, it is likely to damage the back surface of the intermediate transferring belt 11. Therefore, the metal roller which has a greatest contact angle with respect to the intermediate transferring belt 11 is preferable as a part which is replaced with the smooth roller. Further, in a case of the color printer 1 having the image forming section 3 shown in FIG. 2, a contact angle α of the belt supporting roller 14 is greater than a contact angle β of the backup roller 15 and a contact angle of the tension roller 17. Accordingly, the metal roller having a greatest contact angle with respect to the intermediate transferring belt 11 is the belt supporting roller 14.

A metal roller having a greatest contact area with respect to the intermediate transferring belt 11 is likely to damage the back surface of the belt if a surface of the metal roller has irregularity. Therefore, the metal roller which is in pressed contact with the belt is favorable as a part which is replaced with the smooth roller. Further, in a case of the color printer 1 having the image forming section 3 shown in FIG. 2, the metal roller having a greatest contact area with respect to the intermediate transferring belt 11 is the belt supporting roller 14 like the metal roller having a greatest contact angle with respect to the intermediate transferring belt 11.

Furthermore, that all of the metal rollers used as the driven rollers are the smooth rollers in any of the above three cases is preferable in view that the effect of preventing occurrence of the uneven thickness of the intermediate transferring belt 11 can be achieved.

It is preferable that the metal roller is a hollow tube or a hollow tube with radially extending inner arms (a hollow tube having a cross section with 3 internal arms radially extending from the central axis thereof: hereinafter referred to as "a hollow tube with radially extending inner arms" for simplicity) which is hollow in an axial direction. The hollow tube and the hollow tube with radially extending inner arms are lighter than a solid shaft and the like having the same shape. Therefore, it is driven by the rotation of the intermediate transferring roller easier than the solid rod and the like, so is preferable. Further, it is preferable since the hollow tube with radially extending inner arms is easily driven and also has a high strength. Accordingly, when a tensile force is applied to the intermediate transferring belt 11 so that the intermediate transferring belt 11 is not deformed, a weight of the tube allows the intermediate transferring belt 11 not to be easily deformed.

Further, the smooth roller can be manufactured by applying an electroless nickel to a surface of, for example, a roller made of aluminum and buffing the surface until the surface roughness Rz is satisfied.

Second Embodiment

Figure 3:
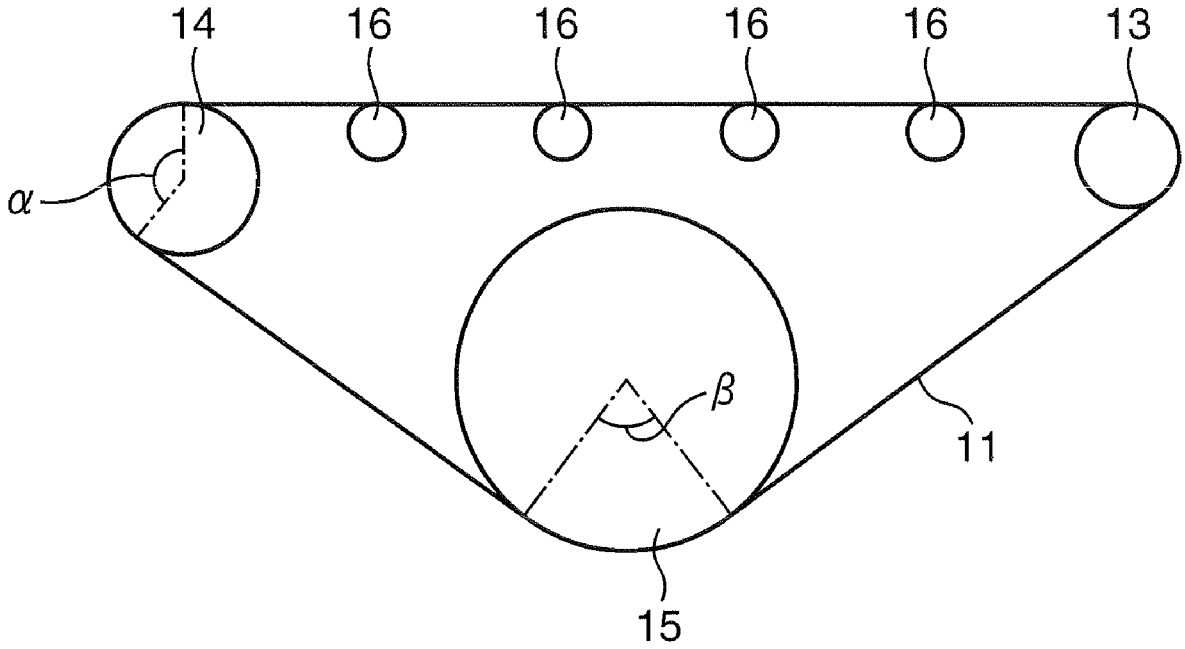
FIG. 3 is an enlarged view showing relevant parts of a configuration of a periphery of an intermediate transferring belt 11 of a color printer in accordance with a second embodiment of the present invention.

Next, a color printer having a configuration in which the intermediate transferring belt 11 and a plurality of rollers, around which the intermediate transferring belt 11 is wound, of the color printer 1 according to the first embodiment of the present invention are changed in such a manner as shown in FIG. 3 will be described. The parts corresponding to the color printer 1 according to the first embodiment of the present invention will be identified by the same reference signs, and descriptions of those will be omitted to avoid duplication of descriptions.

FIG. 3 is an enlarged view showing relevant parts of a configuration of a periphery of an intermediate transferring belt 11 of a color printer in accordance with a second embodiment of the present invention.

When the intermediate transferring belt 11 and the plurality of rollers, around which the intermediate transferring belt 11 is wound, have the configuration as shown in FIG. 3, a contact angle α of the belt supporting roller 14 is greater than a contact angle β of the backup roller 15 and a contact angle of the tension roller 17. Accordingly, a metal roller having a greatest contact angle with respect to the intermediate transferring belt 11 is the belt supporting roller 14. The metal roller having a greatest contact area with respect to the intermediate transferring belt 11 is the backup roller 15 which is not a metal roller having a greatest contact angle with respect to the intermediate transferring belt 11.

Thus, in a case where the metal roller having a greatest contact angle with respect to the intermediate transferring belt 11 is a roller which is likely to damage the back surface of the intermediate transferring belt 11, providing the belt supporting roller 14 which is at least the smooth roller achieves an effect of preventing occurrence of the uneven thickness of the intermediate transferring belt 11 most effectively. Further, in a case where a metal roller having a greatest contact area with respect to the intermediate transferring belt 11 is a roller which is likely to damage the back surface of the intermediate transferring belt 11, providing the backup roller 15 which is at least the smooth roller achieves the effect of preventing occurrence of the uneven thickness of the intermediate transferring belt 11.

If all of metal rollers used as driven rollers are the smooth rollers, it is preferable in view that the effect of preventing occurrence of the uneven thickness of the intermediate transferring belt 11 can be achieved like the case of the color printer 1 according to the first embodiment.

Third Embodiment

As described above, the image forming apparatuses (color printers) according to the first embodiment and the second embodiment are so configured that the intermediate image transferring member includes a belt (intermediate transferring belt 11). Hereinafter, an image forming apparatus according to a third embodiment will be described which is so configured that a transfer member conveying member adapted to convey a transfer member onto which a toner image bore by the image bearing member is directly transferred includes a belt (transfer member conveying belt). The parts corresponding to those of the color printer 1 according to the first embodiment of the present invention will be identified by the same reference signs, and descriptions of those will be omitted to avoid duplication of descriptions.

Figure 4:
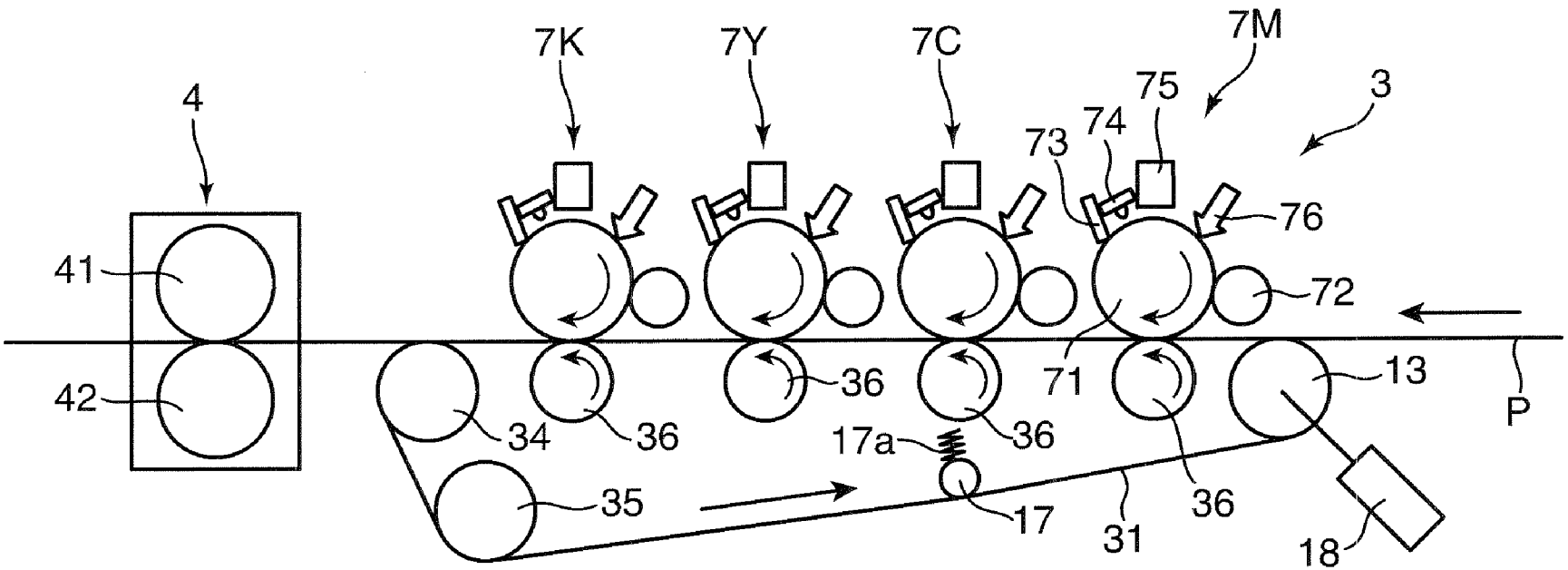
FIG. 4 is an enlarged view showing relevant parts of a configuration of a periphery of the image forming section 3 of a color printer in accordance with a third embodiment of the present invention.

FIG. 4 is an enlarged view showing relevant parts of a configuration of a periphery of the image forming section 3 of a color printer in accordance with a third embodiment of the present invention. The color printer in accordance with the third embodiment of the present invention has a configuration which is generally the same as that of the color printer in accordance with the first embodiment, other than a configuration of the image forming section 3.

The image forming section 3 includes image forming units 7 and a transfer member conveying belt 31 for conveying a transfer member (sheet P) onto which toner images are transferred by the image forming units 7.

Each of the image forming units 7 transfers a toner image formed on a peripheral surface of a respective photoconductive drum 71 to a sheet P.

The transfer member conveying belt 31 is an endless belt which is wound around a plurality of rollers including a driving roller 13, a first belt supporting roller 34 (belt supporting roller 14), a second belt supporting roller 35 (backup roller 15), transferring rollers 36 (primary transferring roller 16), and a tension roller 17. Further, the transfer member conveying belt 31 is so configured that a sheet P is placed on a surface of the belt so that the sheet P is conveyed between the photoconductive drums 71 and the transferring rollers 36.

The first belt supporting roller 34, the second belt supporting roller 35, the transferring rollers 36, and the tension roller 17 are driven rollers which are provided rotatably by endless rotation of the transfer member conveying belt 31 rotated by the driving roller 13.

The transferring roller 36 applies a transfer bias (having a polarity which is opposite to that of toners) to a sheet P conveyed by the transfer member conveying belt 31. Accordingly, toner images formed respectively on the photoconductive drums 71 are transferred between the photoconductive drums 71 and the transfer member conveying belt 31 onto the sheet P in superimposition, so that a color transferred image is formed on the sheet P.

Having configurations of the driven rollers 34, 35, 36, 17 to be similar to those of the first embodiment achieves the effect of the present invention of preventing occurrence of uneven thickness of the transfer member conveying belt 31 and allows a high-quality image to be formed even after a long-time use.

Fourth Embodiment

Next, an image forming apparatus according to a fourth embodiment of the present invention will be described which is so configured that an image bearing member which bears a toner image formed by the electrophotographic method includes a belt (photoconductive belt). The parts corresponding to the first through third embodiments of the present invention will be identified by the same reference signs, and descriptions of those will be omitted to avoid duplication of descriptions.

Figure 5:
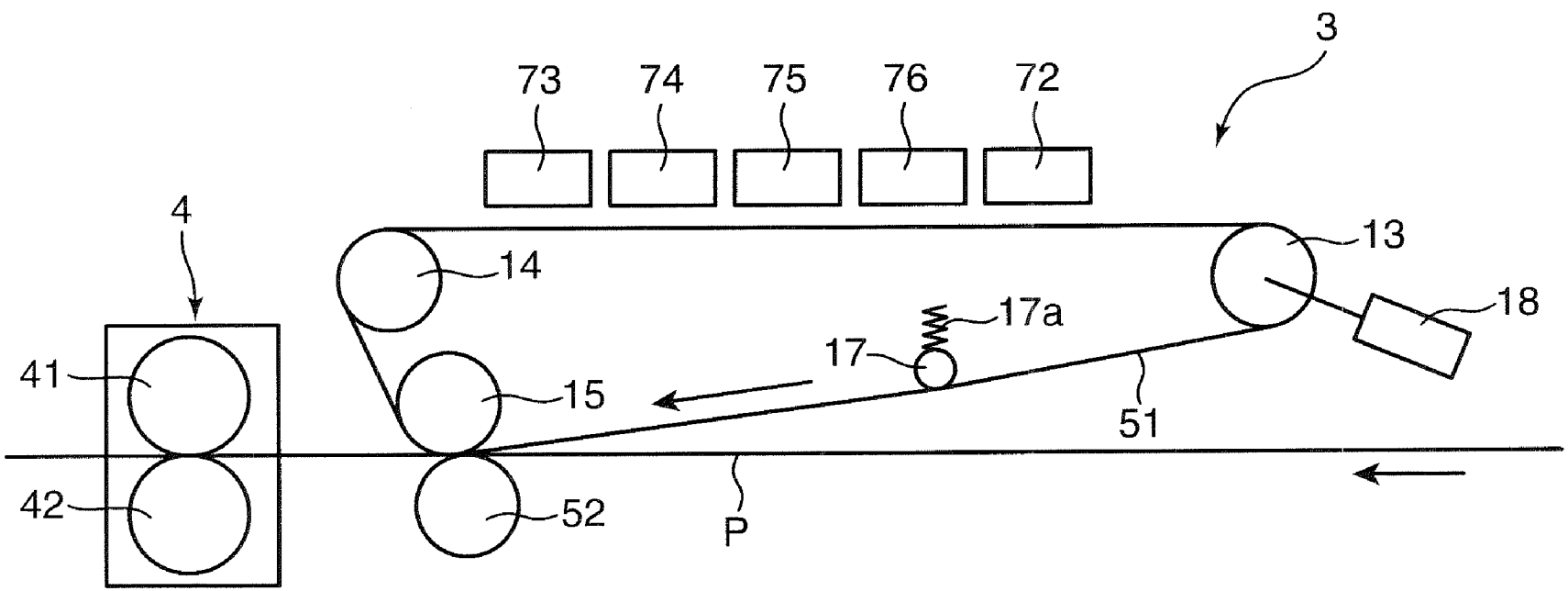
FIG. 5 is an enlarged view showing relevant parts of a configuration of a periphery of the image forming section of a color printer in accordance with a fourth embodiment of the present invention.

FIG. 5 is an enlarged view showing relevant parts of a configuration of a periphery of the image forming section 3 of a color printer in accordance with a fourth embodiment of the present invention. The color printer in accordance with the fourth embodiment of the present invention has a configuration which is generally the same as that of the color printer in accordance with the first embodiment, other than a configuration of the image forming section 3.

The image forming section 3 includes a photoconductive belt 51, and a charging device 75, an exposure device 76, a developing device 72, a cleaning device 73, and a charge removing device 74 for forming a toner image on a surface of the photoconductive belt 15, and a transferring roller 52 for transferring the toner image formed on the photoconductive belt 15 to a sheet P conveyed from the sheet feeding cassette 21. The charging device 75, the exposure device 76, the developing device 72, the cleaning device 73, and the charge removing device 74 are sequentially provided in periphery of the photoconductive drum 71 from upstream side in a rotation direction upstream side.

The photoconductive belt 51 is an endless belt which is wound around a plurality of rollers including a driving roller 13, a belt supporting roller 14, a backup roller 15, and a tension roller 17. Further, the photoconductive belt 51 is so configured that a toner image is formed on a surface of the belt, and the toner image is transferred to the conveyed sheet P.

The transferring roller 52 (secondary transferring roller 12) applies a transfer bias, which has an opposite polarity with respect to that of the toner image, to the sheet P. Accordingly, the toner image transferred to the photoconductive belt 51 is transferred to the sheet P between the transferring roller 52 and the backup roller 15, so that a color transferred image is formed on the sheet P.

Having configurations of the driven rollers 14, 15, 17 to be similar to those of the first embodiment achieves the effect of the present invention of preventing occurrence of uneven thickness of the photoconductive belt 51 and allows a high-quality image to be formed even after a long-time use.

Experimental Results

Hereinafter, working examples as results of applying the present invention to the color printer 1 of the first embodiment (Results of the present invention) are described along with comparative examples (Comparison Results).

The working examples and the comparative examples are of the case where an image forming section (image forming unit) of an existing tandem-type color printer (a color printer of an intermediate transfer type as shown in FIG. 1) is replaced with each of the following image forming units. Each of the image forming units to be replaced is an image forming unit including metal rollers as driven rollers 1 having a respective surface roughness Rz and surface arithmetic inclination average Δa as shown in a table 1. Further, the circle "○" shown next to values of the surface roughness Rz and the surface arithmetic inclination average Δa indicate that the values are within a predetermined value range of the present invention.

Figure 6A:
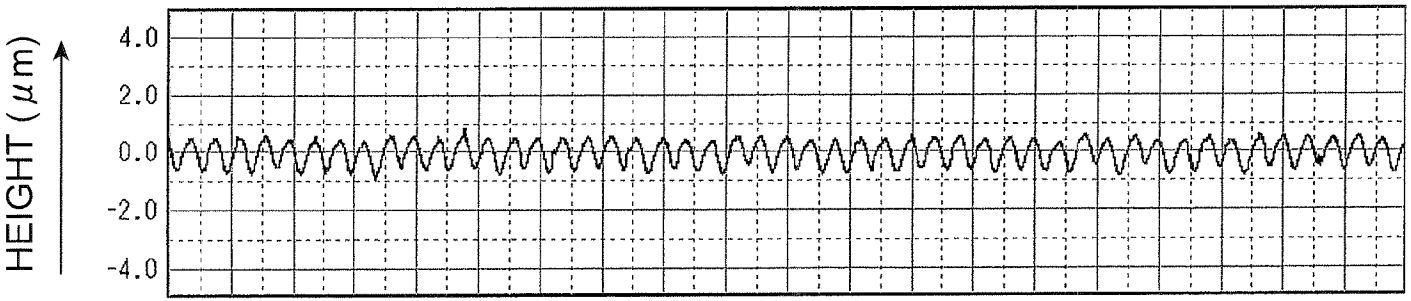
FIG. 6 is a graph showing a roughness curve of a surface of the metal roller used in a working example 1 and comparative examples 1 and 2.
Figure 6B:
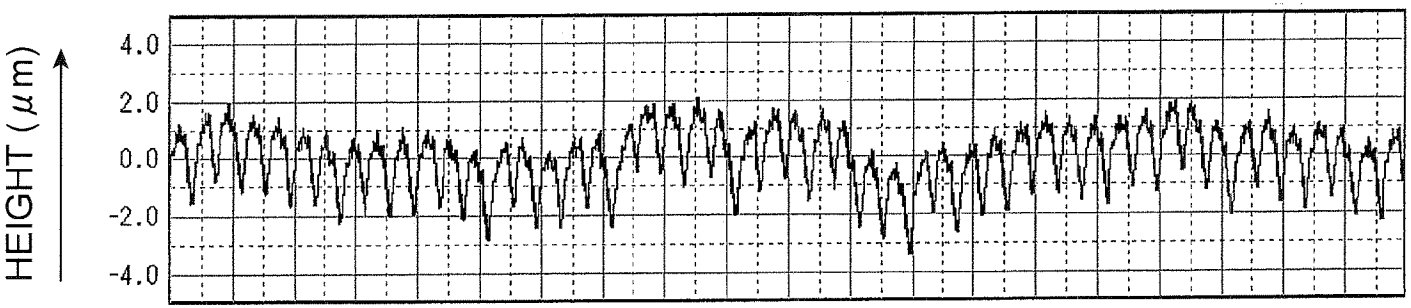
Figure 6C:
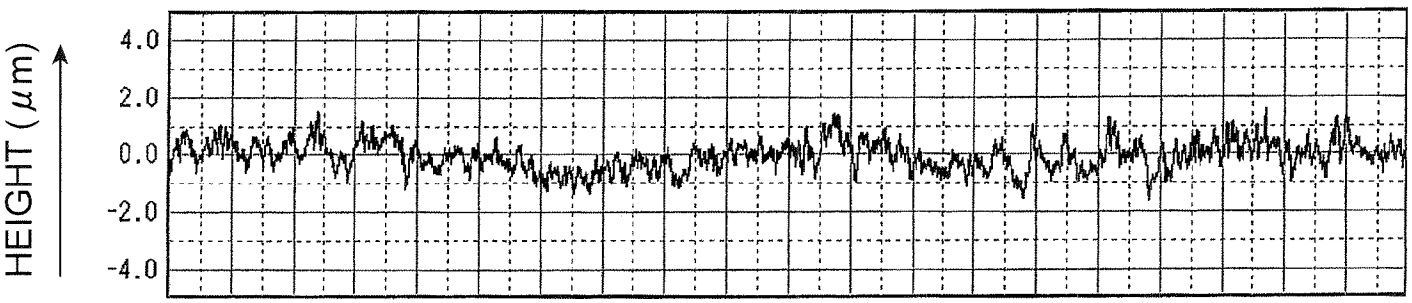

FIG. 6 show graphs respectively showing surface roughness curves of the metal rollers used in the working example 1 and the comparative examples 1, 2. In each of the graphs, a vertical axis indicates a height (μm) of the roughness curve, and a horizontal axis indicates given positions of the roughness curve. FIG. 6A shows a roughness curve of a surface of a metal roller used in the working example 1, and FIG. 6B shows a roughness curve of a surface of a metal roller used in the comparative example 1, and FIG. 6C shows a roughness curve of a surface of a metal roller used in the comparative example 2.

As can be seen in FIG. 6A, the metal roller used in the working example has no large projections on a surface of the metal roller, and inclinations of small irregularity existing on the surface are very small. Accordingly, the metal roller used in the working example is a smooth roller having a smooth surface with small numbers of projections formed on the surface.

As can be seen in FIG. 6B, the metal roller used in the comparative example 1 has large projections on a surface of the metal roller, and inclinations of irregularity existing on the surface are large.

As can be seen in FIG. 6C, the metal roller used in the comparative example 2 does not have large projections on a surface of the metal roller, but inclinations of small irregularity existing on its surface are large. Accordingly, projections formed on the surface are small, but have a greater number than those of the metal roller used in the comparative example 1.

The surface roughness Rz and the surface arithmetic inclination average Δa shown in the table 1, and the roughness curves shown in FIG. 6 are the values obtained by a measurement method which is compatible to JIS (1994). In particular, these are the values obtained by measuring the belt supporting roller 14 of FIG. 2 with use of a surface roughness/contour shape measuring machine (SURFCOM1500DX manufactured by Tokyo Seimitsu Co., Ltd.) under the following conditions. The conditions are so set that measurement class be a roughness measurement, a measurement length be 4.0 mm, a cut-off wavelength be 0.8 mm, a measurement speed be 0.3 mm/s, and an evaluation length be 4.0 mm.

The working examples and the comparative example are evaluated in such a manner as described herebelow.

Firstly, an intermittent driving of forcibly driving the image forming unit for two seconds with use of a drive power source and giving one second interval is performed. The image forming unit is mounted to another evaluation machine (color printer) at every predetermined time to form a half-tone image. The formed half-tone image is checked with eyes. The checking with eyes is performed to confirm whether or not there exists density unevenness on the half-tone image. When the half-tone image having the density unevenness is formed, it is determined that the uneven thickness occurs on the intermediate transferring belt. Accordingly, a time length between starting of the image forming and forming of an image having a density unevenness is measured as an uneven thickness generation time of the intermediate transferring belt. The results are shown in the table 1. It can be determined that occurrence of uneven thickness on the intermediate transferring belt indicates damages on the back surface.

TABLE 1

| | Surface Roughness Rz (μm) | | Arithmetic Inclination Average Δa | | Occurrence Time (time) | |
|---|---|---|---|---|---|---|
| Working Ex. 1 | 1.8 | ○ | 0.0389 | ○ | 300 | ○ |
| Working Ex. 2 | 2.0 | ○ | 0.0553 | ○ | 260 | ○ |
| Working Ex. 2 | 1.8 | ○ | 0.0427 | ○ | 250 | ○ |
| Comparative Ex. 1 | 2.5 | X | 0.0747 | X | 100 | Δ |
| Comparative Ex. 2 | 2.0 | ○ | 0.0907 | X | 80 | X |
| Comparative Ex. 3 | 2.0 | ○ | 0.0703 | X | 140 | Δ |

Each of the metal rollers used in the working examples 1 through 3 is manufactured by applying an electroless nickel plating to a surface of an aluminum hollow tube with radially extending inner arms, buffing the surface with a buffing material #100 (according to Japan Industrial Standard), and further buffing the surface with a buffing material #150 (according to Japan Industrial Standard). The metal roller used in the comparative example 1 is a metal roller which is generally used in an existing tandem-type color printer, and is manufactured by polishing a surface of an aluminum hollow tube with radially extending inner arms without plating the surface. The metal roller used in the comparative example 2 is manufactured by applying an electroless nickel plating to a surface of an aluminum hollow tube with radially extending inner arms without polishing the surface. The metal roller used in the comparative example 3 is manufactured by applying an electroless nickel plating to a surface of an aluminum hollow tube with radially extending inner arms and buffing the surface with the buffing material #100.

As can be understood from the table 1, when a driven roller including a smooth roller having a surface roughness Rz of 2 μm or less and a surface arithmetic inclination average Δa of 0.06 or less is used (working examples 1 through 3), the uneven thickness of the intermediate transferring belt becomes unlikely to occur, so that a favorable image forming can be maintained for a long time.

On the other hand, when a metal roller having a surface roughness Rz greater than 2 μm and a surface arithmetic inclination average Δa greater than 0.06 is used (comparative example 1), the uneven thickness of the intermediate transferring belt becomes likely to occur as compared to the working examples 1 through 3, so that favorable image forming is lost in a short period of time.

Further, when the metal rollers each having a surface roughness Rz of 2 μm or less and a surface arithmetic inclination average Δa greater than 0.06 are used (the comparative examples 2 and 3), the uneven thickness of the intermediate transferring belt becomes likely to occur as compared to the working examples 1 through 3, so that favorable image forming is lost in a short period of time, like the case of the comparative example 1. According to the results above, it can be seen that the uneven thickness of the intermediate transferring belt cannot be prevented sufficiently if the surface arithmetic inclination average Δa is 0.06 or less. Therefore, it is important that the surface arithmetic inclination average Δa be small to prevent the uneven thickness of the intermediate transferring belt, and it is clear that the invention disclosed in the patent document 1 cannot prevent the uneven thickness sufficiently.

Further, as comparing the comparative example 1 and the comparative example 3 having the surface arithmetic inclination averages Δa which are nearly equal, the comparative example 3 having a surface roughness Rz of 2.0 μm could maintain a favorable image forming for a longer time than the comparative example 1 having a surface roughness Rz of 2.5 μm. Accordingly, it can be seen that it is important to make not only the surface arithmetic inclination average Δa but also the surface roughness Rz be small to prevent the uneven thickness of the intermediate transferring belt.

According to the results described above, it can be considered that not only the sizes of projections formed on the surface of the metal roller but also the number of projections (sizes of Δa has a correlative relationship with the number of projections per unit area) affects on a cause of damages to the back surface of the intermediate transferring belt. In other words, larger the sizes of projections or larger the number of projections causes a time during which a favorable image forming can be maintained to become shorter. Therefore, it would not be enough to make the surface roughness Rz of the metal roller used as the driven roller be small, and it would be also necessary to make the surface arithmetic inclination average Δa be small.

As described above, using the metal roller defining the surface roughness Rz and the arithmetic inclination average Δa like the present invention as the driven roller prevents occurrence of the uneven thickness of the belt, so that a high-quality image forming can be maintained even after a long-time use.

(1) In summary, the present invention includes an image forming apparatus comprising: a plurality of rollers; and an endless belt wound around said rollers, said rollers including: a driving roller which drives said belt wound around said rollers and a driven roller set which is driven by said driving roller via the movement of the endless belt, said driven rollers having one or more metal rollers. At least one of said metal rollers is a smooth roller which satisfies following conditions (i) and (ii); (i) a surface roughness Rz≦2 μm; and (ii) an arithmetic inclination average $\Delta a \leqq 0.06$; where said $\Delta a$ is obtained from an equation (1) below:

$$\Delta a = \frac{1}{L}\int_0^L \left|\frac{d}{dx}f(x)\right| dx \quad (1)$$

where

L=a reference length taken from a roughness curve; and f (x)=a height of the roughness curve at a position x within said reference length L along a lengthwise direction of the roller being measured.

According to this configuration, since a surface roughness Rz of the metal roller in a frictional contact with the belt is such a small value of 2 μm or less, there is no large projection on the surface of the metal roller. Further, since an arithmetic inclination average $\Delta a$ of the surface of the metal roller is such a small value of 0.06 or less, inclination of small irregularity existing on the surface is very small. Accordingly, since the metal roller is a smooth roller having a very smooth surface, it can prevent occurrence of damages on the back surface of the belt caused by the metal roller. Thus, according to the present invention, the back surface of the belt is not likely to be damaged, so that occurrence of the uneven thickness of the belt can be prevented, and a high-quality image can be formed even after a long-time use.

Further, even though the smooth roller may be adopted in any of the metal rollers to achieve an effect of preventing occurrence of the uneven thickness of the belt when a plurality of metal rollers are used as driven rollers in the image forming apparatus, it is preferable to have the configurations described herebelow.

A metal roller which comes in pressed contact with the belt most strongly is likely to damage a back surface of the belt when it has irregularity on its surface. Therefore, the metal roller which comes in pressed contact with the belt most strongly is preferable as a part which is replaced with the smooth roller.

A metal roller having a greatest contact angle of the belt comes in contact with the belt for a relatively long area (time). If such roller has irregularity on its surface, it is likely to damage the back surface of the belt. Therefore, the metal roller which has a greatest contact angle with respect to the belt is preferable as a part which is replaced with the smooth roller.

A metal roller having a greatest contact area with respect to the belt is likely to damage the back surface of the belt if a surface of the metal roller has irregularity. Therefore, the metal roller which is in pressed contact with the belt is favorable as a part which is replaced with the smooth roller.

That all of the metal rollers used as the driven rollers are the smooth rollers in any of the above three cases is preferable on the point that the effect of preventing generation of the uneven thickness of the belt can be achieved.

Further, it is preferable that the metal roller is a hollow tube or a hollow tube with radially extending inner arms which is hollow in an axial direction. The hollow tube and the hollow tube with radially extending inner arms are lighter than a solid shaft and the like having the same shape. Therefore, it is driven by the rotation of the intermediate transferring roller easier than the solid rod and the like, so is preferable. Furthermore, it is preferable since the hollow tube with radially extending inner arms is easily driven and also has a high strength. Accordingly, when a tensile force is applied to the belt so that the belt is not deformed, a weight of the tube allows the belt not to be easily deformed.

It is preferable that the driving roller is a roller having an elastic member layer including an urethane rubber. Such configuration allows the belt to be driven without damaging the back surface of the belt.

The belt may be any of an intermediate transferring belt, a transfer member conveying belt, or a photoconductive belt to enjoy the effect of the present invention.

According to the present invention, the back surface of the belt is not likely to be damaged, so that occurrence of the uneven thickness of the belt can be prevented. Thus, a high-quality image can be formed even after a long-time use.

This application is based on Japanese Patent Application Serial No. 2007-016431 filed in Japan Patent Office on Jan. 26, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a plurality of rollers; and an endless belt wound around said rollers, said rollers including:

a driving roller which drives said belt wound around said rollers and a driven roller set which is driven by said driving roller via the movement of the endless belt, said driven rollers having one or more metal rollers, and wherein at least one of said metal rollers is a smooth roller which satisfies following conditions (i) and (ii);

(i) a surface roughness $Rz \leqq 2$ μm; and (ii) an arithmetic inclination average $\Delta a \leqq 0.06$;

where said $\Delta a$ is obtained from an equation (1) below:

$$\Delta a = \frac{1}{L}\int_0^L \left|\frac{d}{dx}f(x)\right| dx \quad (1)$$

where

L=a reference length taken from a roughness curve; and f (x)=a height of the roughness curve at a position x within said reference length L along a lengthwise direction of the roller.

2. The image forming apparatus according to claim 1, wherein when said metal rollers are used, a metal roller which comes in pressed contact with the belt most strongly is said smooth roller.

3. The image forming apparatus according to claim 1, wherein when said metal rollers are used, a metal roller having a greatest contact angle with respect to said belt is said smooth roller.

4. The image forming apparatus according to claim 1, wherein when said metal rollers are used, a metal roller having a greatest contact area with respect to said belt is said smooth roller.

5. The image forming apparatus according to claim 1, wherein all of said metal rollers are said smooth rollers.

6. The image forming apparatus according to claim 5, wherein each of said metal rollers is a hollow tube or a hollow tube with radially extending inner arms, which is hollow in an axial direction.

7. The image forming apparatus according to claim 1, wherein said driving roller is a roller whose surface has an elastic member layer.

8. The image forming apparatus according to claim 1, wherein said belt is an intermediate transferring belt, a transfer member conveying belt, or a photoconductive belt.

* * * * *